United States Patent [19]

Haller et al.

[11] 4,076,217

[45] Feb. 28, 1978

[54] APPARATUS FOR LIFTING A MANHOLE COVER

[76] Inventors: George S. Haller, 359 Colt Drive; Theodore C. Uphoff, 1298 Richard Road, both of North Huntingdon, Pa. 15642

[21] Appl. No.: 686,417

[22] Filed: May 14, 1976

Related U.S. Application Data

[62] Division of Ser. No. 561,863, Mar. 25, 1975, Pat. No. 3,957,247.

[51] Int. Cl.[2] ..... B66F 11/00

[52] U.S. Cl. ..... 254/131

[58] Field of Search ..... 254/1, 131, 120; 294/15, 17, 18

[56] References Cited

U.S. PATENT DOCUMENTS

| | | | |
|---|---|---|---|
| 339,591 | 4/1886 | Stevenson | 254/131 |
| 2,297,556 | 9/1942 | Hermann | 254/DIG. 1 |

*Primary Examiner*—Al Lawrence Smith
*Assistant Examiner*—Robert C. Watson
*Attorney, Agent, or Firm*—James O. Ray, Jr.

[57] ABSTRACT

An apparatus is disclosed for lifting a manhole cover which comprises; (1) a means for engaging the manhole cover which cooperates with a lever means for raising and lowering the cover, and (2) a pivot means which also cooperates with the lever means to pivot the cover to the desired position.

9 Claims, 7 Drawing Figures

APPARATUS FOR LIFTING A MANHOLE COVER

BACKGROUND OF THE INVENTION

This is a divisional application of our earlier copending application, Ser. No. 561,863, filed Mar. 25, 1975, now U.S. Pat. No. 3,957,247.

This invention relates to manhole covers and, more particularly, to an apparatus for raising and lowering manhole covers.

Prior to our invention, it was customary for one person to use a pick to wedge open or pry up one edge of the manhole cover. A second person would then grab the partially raised cover and hold it until his partner could also help him move the cover.

Some covers can weigh up to about 400 pounds and many serious injuries have resulted from this method of handling manhole covers. To the best of our knowledge, the only attempt to overcome the hazards and difficulties associated with handling manhole covers has been the use of a chain fall secured to a tripod. However, this arrangement did not provide a convenient way of pivoting the cover to a desired final position. For this reason and because it is cumbersome, the arrangement has received very little acceptance by industry.

BRIEF SUMMARY OF THE INVENTION

The apparatus comprises a means for engaging the manhole cover which cooperates with a means for raising and lowering the manhole cover. A pivot means is also provided which cooperates with the means for raising and lowering the manhole cover.

OBJECTS OF THE INVENTION

It is therefore the primary object of our invention to provide an apparatus for raising and lowering a manhole cover that requires only one person to operate.

Another object of our invention is to provide an apparatus for pivoting the manhole cover to any desired position.

Still another object of our invention is to provide an apparatus that eliminates handling the manhole cover by hand thereby reducing a safety hazard.

Yet another object of our invention is to provide an apparatus that is lightweight and economical to produce.

A further object of our invention is to provide an apparatus which can be adapted for use with present manhole covers.

Still yet another object of our invention is to provide a means to prevent the manhole cover from slipping on the lifting lever.

These and various other objects and advantages of our invention will become apparent when taken in conjunction with the following detailed description and the attached drawings.

DESCRIPTION OF THE PREFERRED EMBODIMENT

Now refer to FIGS. 1 through 4 wherein like numerals refer to similar parts throughout the several views. According to our invention we provide a means generally designated as 100, for engaging the manhole cover 2. A lever means generally designated as 110 to cooperate with the means for engaging the manhole cover 2, for raising and lowering the manhole cover and a pivot means, generally designated as 120, which cooperates with the means for raising and lowering the manhole cover 2.

Figure 1:
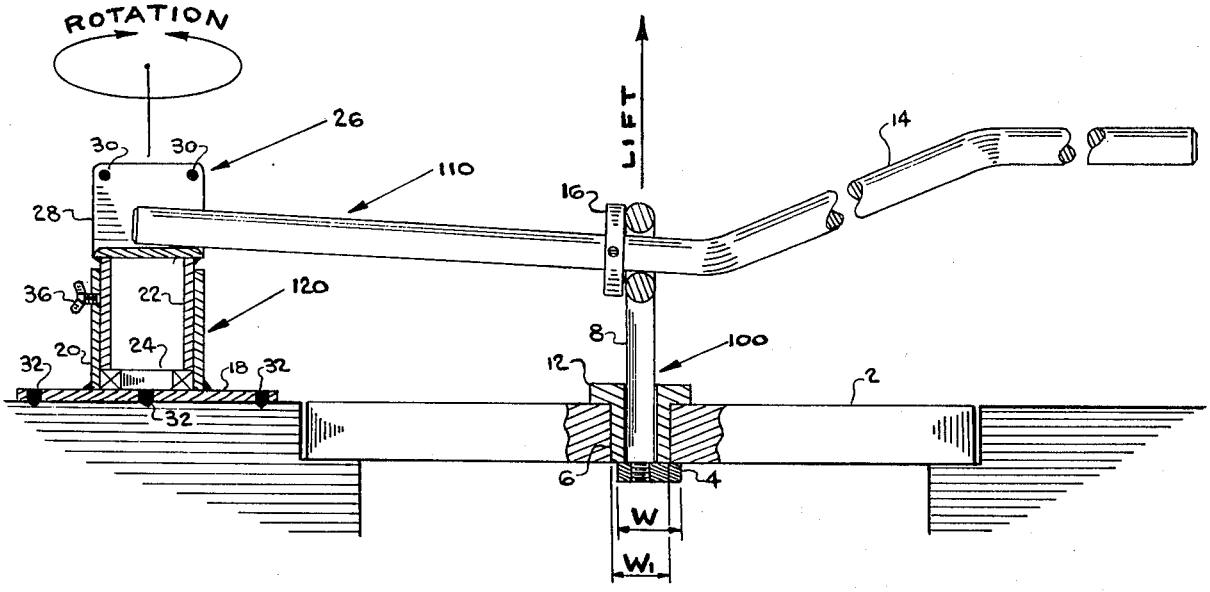
FIG. 1 is an elevation view partially in cross section showing the preferred embodiment of our invention.
Figure 2:
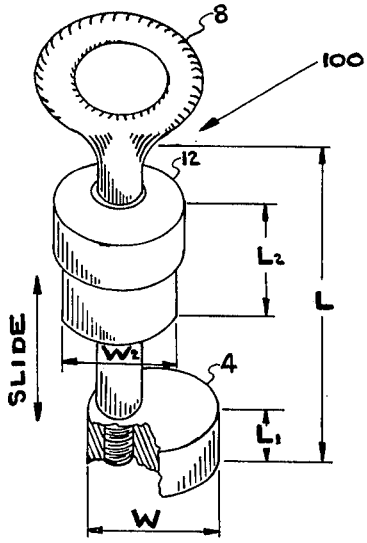
FIG. 2 is an enlarged view showing our preferred means for engaging the manhole cover.
Figure 3:
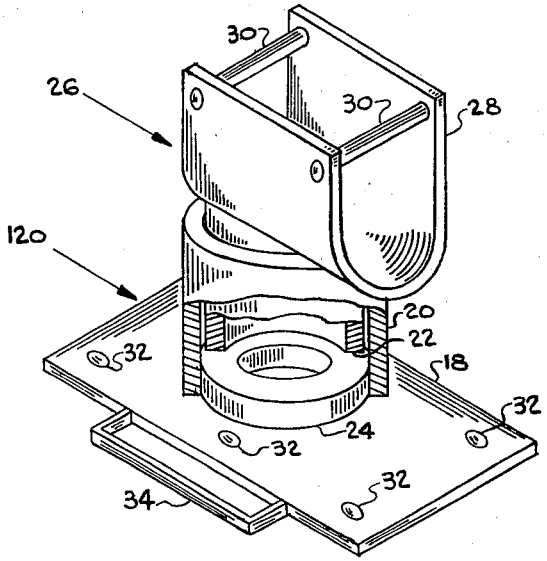
FIG. 3 is an enlarged view showing our preferred pivot means.
Figure 4:
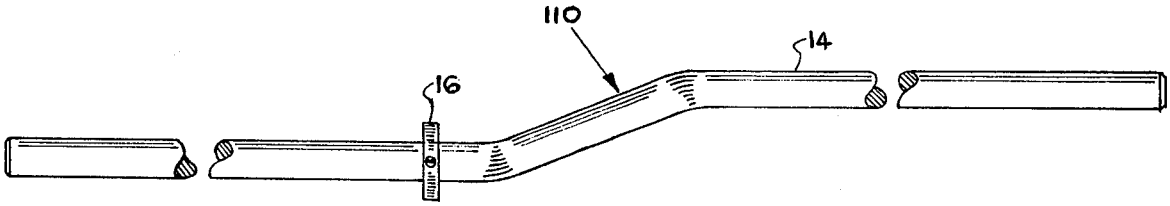
FIG. 4 shows our preferred lever for raising and lowering the manhole cover.

The means, generally designated as 100, for engaging the manhole cover 2 comprises a pad 4, of any desired shape, having a width W which is slightly less than a width $W_1$ of an opening 6 in the manhole cover 2. Secured near one edge of the pad 4 is an eyebolt 8. Eyebolt 8 can be welded to the pad 4 or preferably threaded as shown in FIG. 2. A bushing 12, having a width $W_2$ also slightly less than the width $W_1$ of opening 6 in manhole cover 2, is circumferentially slidably mounted on the shaft of eyebolt 8. It will be understood that the bushing 12 may be provided in a variety of sizes to accommodate different size openings 6 in manhole cover 2 thus the reason for preferably threading eyebolt 8 into pad 4. When eyebolt 8 is threaded into pad 4 the shaft should have a length L at least equal to a length $L_1$ of pad 4 plus two times a length $L_2$ of bushing 12.

The lever means, generally designated 110, for raising and lowering the manhole cover 2 comprises a bar 14 which preferably has an adjustable stop means 16 mounted thereon and adapted to abut the means 100 for engaging the manhole cover 2 at a predetermined location on the bar 14. Stop means 16 prevents manhole cover 2 sliding on bar 14 during lifting.

Pivot means, generally designated 120, comprises a base 18 having a cylindrical tube 20 mounted thereon. A pivot member 22, preferably a pipe, is mounted for pivotal movement inside cylindrical tube 20. A bearing 24 is preferably mounted inside tube 22 and adapted to contact the base 18 and the lower surface of pivot member 22 so that pivot member 22 is prevented from contacting base 18. A means, generally designated 26, is secured adjacent the top of the pivot member 22 and is adapted to be engaged by the means, generally designated 11, for raising and lowering the manhole cover 2. We prefer a generally U-shaped saddle 28 be secured to the top of pivot member 22. The saddle 28 has bars 30 secured to the generally upstanding legs of saddle 28 to prevent spreading of the legs. Pins 32 may be provided on base 18 to prevent base 18 from slipping when used on a hard surface such as asphalt or concrete. A handle 34 could also be provided to facilitate carrying pivot means 12. In addition a wing nut 36 could be used to prevent pivot member 22 from moving inside tube 20 while carrying pivot means 12.

In operation, pivot means 120 is positioned adjacent one edge of manhole cover 2. Lifting means 8 is engaged in manhole cover 2 through opening 6. The bar 14 is placed through eyebolt 8 and a first end is positioned in saddle 28. Pressure is applied by lifting on the second end thereby bringing the upper surface of pad 4 into contact with a portion of the lower surface of manhole cover 2 adjacent opening 6. Continuing to lift until the manhole cover 2 is above ground level and then pivoting the manhole cover to a desired position. The manhole cover 2 is then lowered to the ground level.

In replacing the manhole cover pressure is again applied by lifting on the second end of bar 14 until manhole cover 2 is above ground level then pivoting the manhole cover over the opening in the manhole and lowering the cover over the opening.

ALTERNATIVE EMBODIMENTS

Figure 5:
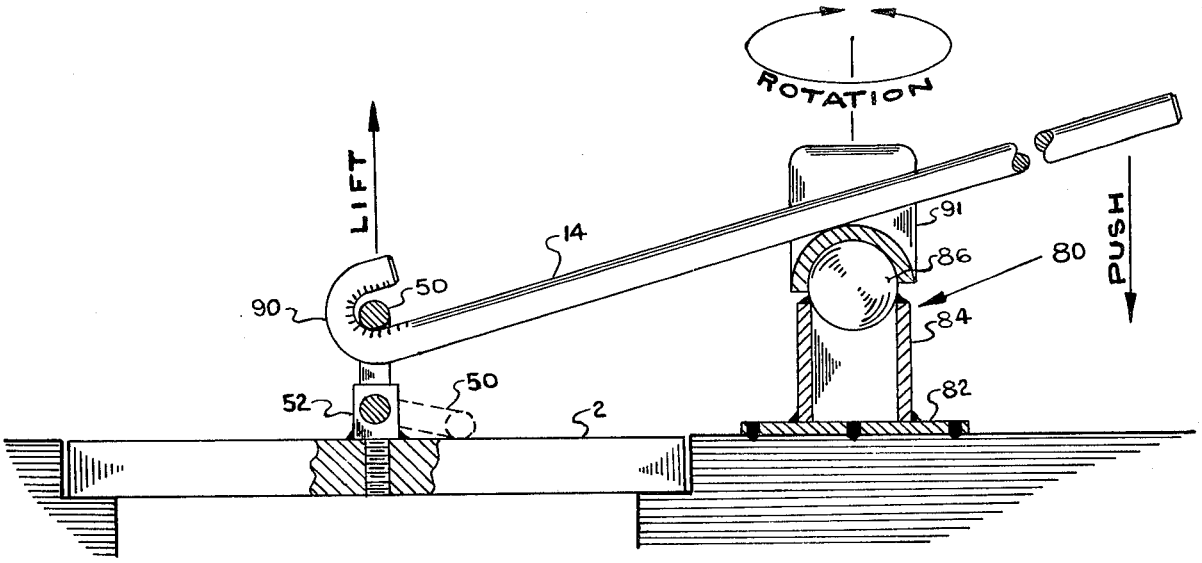
FIG. 5 is an elevation view partially in cross section showing alternative embodiments for means to engage the manhole cover, means to pivot and a lever for raising and lowering the manhole cover.
Figure 6:
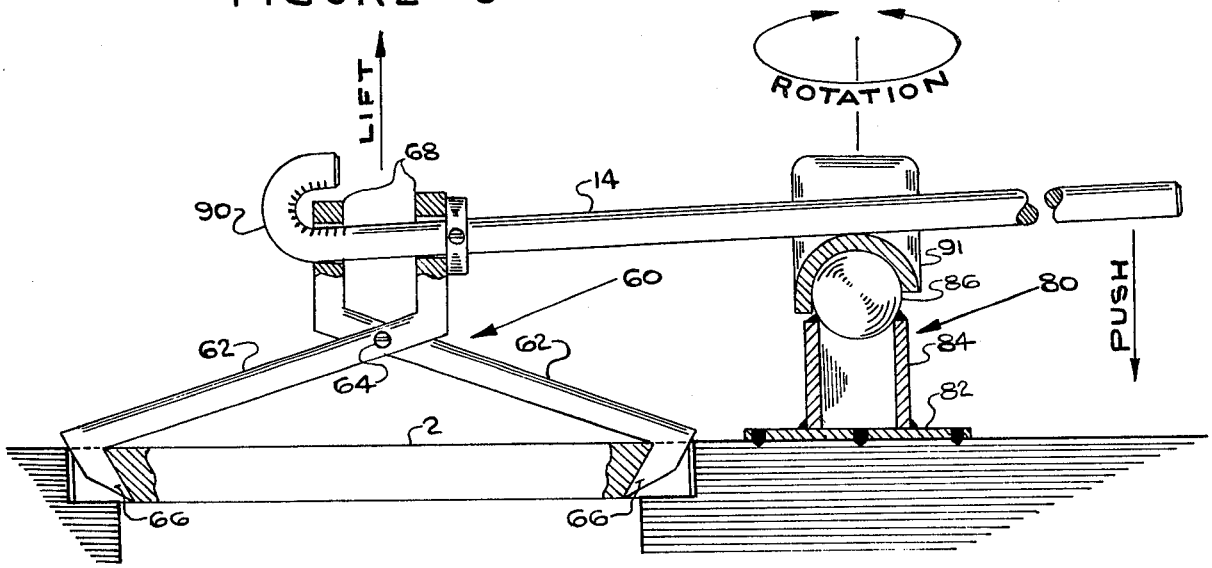
FIG. 6 is an elevation view partially in cross section showing another alternative embodiment for means to engage the manhole cover.
Figure 7:
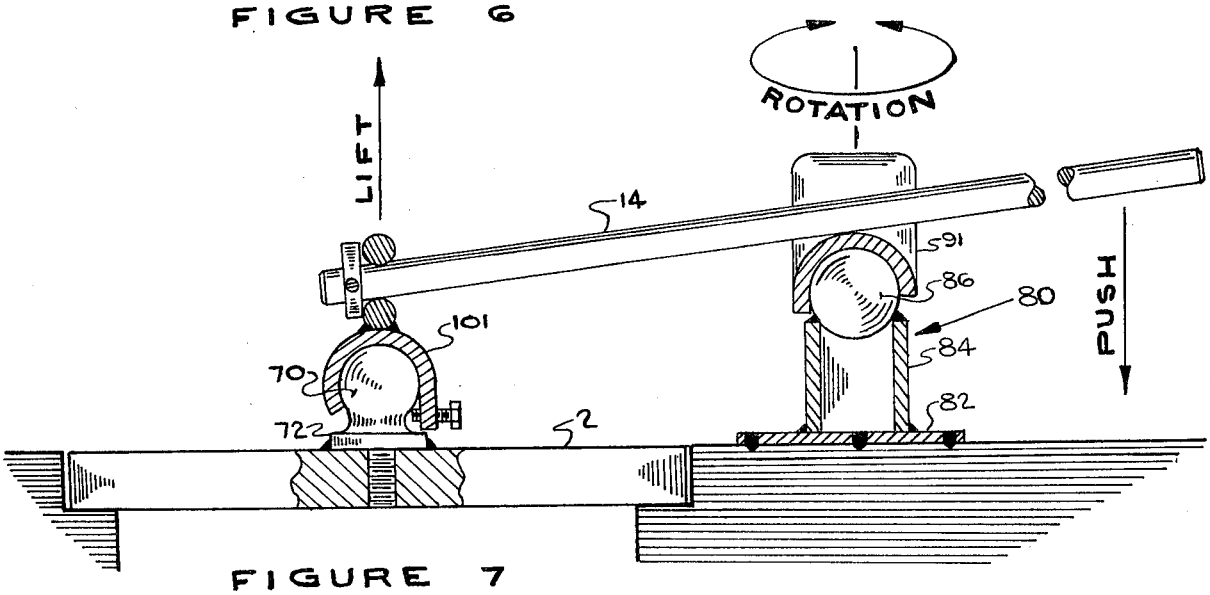
FIG. 7 is an elevation view partially in cross section showing a further alternative embodiment for means to engage the manhole cover and lever for raising and lowering the manhole cover.

Refer now to FIGS. 5 through 7 for an understanding of various alternative embodiments. One means we provide for engaging the manhole cover 2 is with a ring 50 secured thereto such as by a block 52. It should be understood that block 50 could be welded to or threaded into manhole cover 2.

Another means for engaging manhole cover 2 is a scissor type generally designated 60 which comprises a pair of bars 62 pivotally secured together by a pin 64. Bars 62 have a leg 66 adapted to engage the outer edges of manhole cover 2 and a pair of legs 68 adapted to receive a means for raising and lowering the manhole cover 2.

Still another means for engaging manhole cover 2 is a ball 70 having a stem 72 adapted to be welded to or threaded into manhole cover 2.

An alternate pivot means, generally designated 80, comprises a base 82, a support 84 mounted on the base 82 and a ball joint 86 secured adjacent the top of the support 84 for engagement with means for raising and lowering manhole cover 2.

According to one alternate for the means for raising and lowering the manhole cover 2 we provide a hook 90 on a first end of bar 14. Bar 14 in this embodiment is adapted to rest on pivot means 80 or 12 by securing a cup-shaped member 91 thereto. Pressure is applied by pushing downward on the second end of bar 14 to raise the manhole cover 2.

In still another embodiment bar 14 is adapted to engage the ball 70 of the ball-type joint by having a socket 101 which can be secured to a first end of bar 14 if it is desired to apply pressure by pushing to raise manhole cover 2 or it can be secured away from the ends of bar 14 if it is desired to apply pressure by lifting to raise manhole cover 2.

While we have described our preferred and various alternate embodiments of our invention it will be understood by those skilled in the art that various other alternatives and combinations of our invention can be practiced and we intend only to be bound by the scope of the appended claims.

We claim:

1. An apparatus for raising and lowering a manhole cover, said apparatus comprising:

a) a scissor type lifting means for engaging the edges of said manhole cover;

b) a lever which cooperates with said scissor type lifting means for raising and lowering said manhole cover in a vertical direction; and c) a combination fulcrum and pivoting means engageable with said lever to raise said manhole cover and to pivot said manhole cover, in a plane parallel to the surface of the ground, when said manhole cover is in a raised position.

2. An apparatus according to claim 1 further including a stop means on said lever adapted to abut said means for engaging said manhole cover so that said engaging means will not slide on said lever.

3. An apparatus according to claim 2 wherein said stop means is adjustable to a predetermined location on said lever.

4. An apparatus according to claim 1 wherein said lever has a hook on one end for engaging said lifting means.

5. An apparatus according to claim 1 wherein said combination fulcrum and pivoting means includes:

a) a base;

b) a cylindrical tube mounted on said base;

c) a cylindrical pivot member mounted for pivotal movement inside said cylindrical tube; and d) means second to said pivot member-adjacent its top for engagement with said means for raising and lowering said manhole cover.

6. An apparatus according to claim 5 further including a bearing mounted inside said tube and on said base so that said pivot member is prevented from contacting said base.

7. An apparatus according to claim 5 wherein said means adjacent said pivot member is a generally U-shaped saddle.

8. An apparatus according to claim 1 wherein said combination fulcrum and pivoting means includes:

a) a base;

b) a support mounted on said base; and c) means secured to said support adjacent to top for engagement with said means for raising and lowering said manhole cover.

9. An apparatus according to claim 8 wherein said means for engagement with said means for raising and lowering said manhole cover is a ball joint.

* * * * *